US005848030A

United States Patent [19]

Sullivan

[11] Patent Number: 5,848,030

[45] Date of Patent: Dec. 8, 1998

[54] WATCH AND WATCHBAND ARRANGEMENT

[76] Inventor: Scott L. Sullivan, 3 Garden Ridge, Chappaqua, N.Y. 10514

[21] Appl. No.: 772,554

[22] Filed: Dec. 26, 1996

Related U.S. Application Data

[60] Provisional application No. 60/009,373 Dec. 29, 1995.

[51] Int. Cl.[6] ..... G04B 37/00

[52] U.S. Cl. ..... 368/282; 368/283; 368/286

[58] Field of Search ..... 368/281, 282, 368/283, 286; 224/168, 170, 173, 178

[56] References Cited

U.S. PATENT DOCUMENTS

| | | | |
|---|---|---|---|
| 1,763,929 | 6/1930 | Kellner | 368/282 |
| 2,071,221 | 4/1937 | Bradbury | 368/281 |
| 3,111,247 | 11/1963 | Just | 368/282 |
| 3,403,505 | 10/1968 | Gisiger | 368/282 |
| 4,627,739 | 12/1986 | Shingo et al. | 368/282 |
| 4,757,926 | 7/1988 | Leo | 224/178 |
| 4,905,879 | 3/1990 | Piccone | 368/282 |
| 4,916,679 | 4/1990 | Agnello | 368/283 |
| 4,964,092 | 10/1990 | Brida | 368/282 |

FOREIGN PATENT DOCUMENTS

| | | | |
|---|---|---|---|
| 3809894 | 10/1989 | Germany | 224/178 |
| 197915 | 5/1937 | Switzerland | 368/282 |

*Primary Examiner*—Vit W. Miska
*Attorney, Agent, or Firm*—Scott L. Sullivan

[57] ABSTRACT

A wrist watch comprising a watch case containing a timing movement and a watchband defining a longitudinal axis. Securing means is provided to secure the watch case to the watchband so that the watch case may be selectively displaced along a predetermined distance of the longitudinal axis. In one embodiment, securing means includes a protective covering material attached to the watchband and forming a tubular structure. The tubular structure defines a cavity in which a watch case may reside and slide with respect to the watchband. The covering may include one or more openings to selectively expose the watch face from the protective covering.

10 Claims, 2 Drawing Sheets

WATCH AND WATCHBAND ARRANGEMENT

This is a provisional application Ser. No. 60/009,373 filed Dec. 29, 1995.

FIELD OF THE INVENTION

The present invention relates to timepieces, and more particularly, to watchband arrangements and fasteners for securing a watch case to a watchband.

BACKGROUND OF THE INVENTION

A traditional wristwatch case is fastened to a wearer's wrist by a watchband. The watchband is usually made up of two sections, one end of each is attached to opposing sides of the watch case, secured between a pair of parallel support arms which are typically projecting from the case. The remaining open ends of each watchband section buckle, snap, loop-fasten (e.g., with Velcro) or otherwise attach together around a wearer's wrist. A spring-loaded pin is used to secure each band section to the watch case. Each of the two pins fit into sockets which are formed in inwardly directed faces of the projecting support arms.

It is an object of the invention to provide a watch wherein the watch case is held to the watchband without the use of spring pins or projecting support arms, as in the prior art.

It is another object of the invention to provide a watchband which is entertaining, yet functional in holding a watch case to a wearer's wrist.

It is another object of the invention to provide an entertaining and functional watchband for securing small items to a wrist.

SUMMARY OF THE INVENTION

A wrist watch comprising a watch case containing a timing movement and a watchband defining a longitudinal axis. Securing means is provided to secure the watch case to the watchband so that the watch case may be selectively displaced along a predetermined distance of the longitudinal axis. In one embodiment, securing means includes a protective covering material attached to the watchband and forming a tubular structure. The tubular structure defines a cavity in which a watch case may reside and slide with respect to the watchband. The covering may include one or more openings to selectively expose the watch face from the protective covering.

DESCRIPTION OF THE PREFERRED EMBODIMENT OF THE INVENTION

Figure 1:
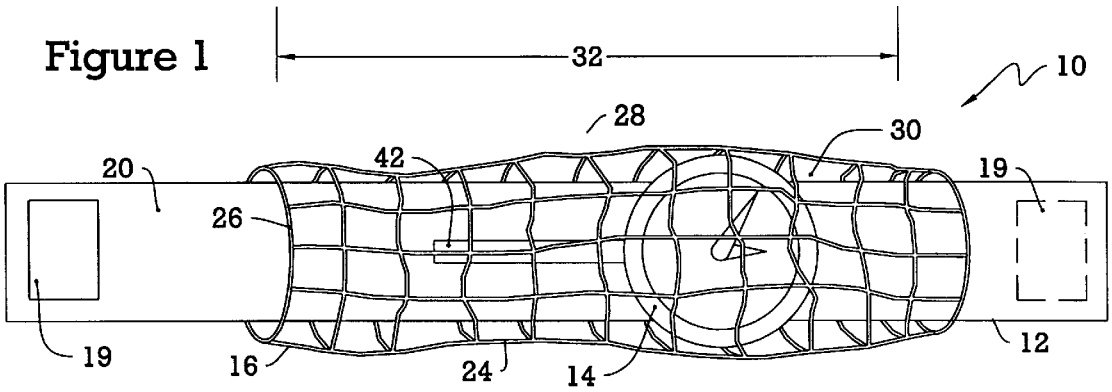
FIG. 1 is a top view of a wristwatch, in accordance with a first embodiment of the invention, including a watchband and a watch case.
Figure 2:
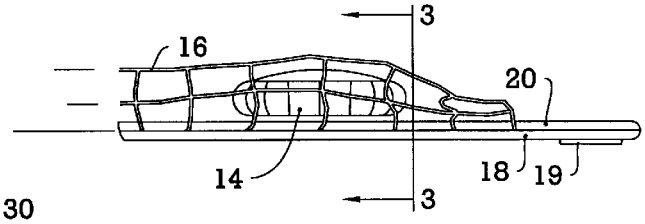
FIG. 2 is a partial side view of the wristwatch of FIG. 1.

Referring to FIG. 1, a wristwatch 10, in accordance with a preferred embodiment of the invention is shown, including a watchband 12, a watch case 14, and a covering 16. The watchband 12 is preferably made from a laminate of at least two layers of elongated strips, an inner layer 18 which contacts the wearer's skin when the watch is worn (or is at least directed inwardly towards the wearer's wrist), and an outer layer 20 which remains in view (or is at least directed outwardly away from the wearer's wrist). The watchband 12 may be a complete loop which is intended to be slipped over a wearer's hand and wrist, or made with open ends which may be secured to each other around a wearer's wrist.

Both inner layer 18 and outer layer 20 are preferably made from a flexible material, including leather, rubber, plastic, or any fabric including sweatband material (i.e. terry cloth type of woven fabric made from ANTRON yarn manufactured and sold by the Dupont Company), canvas, denim, string, or a wire or cloth scrim or lace. The inner layer 18 may also be a conventional watchband. Outer layer 20 is preferably made colorful, depending on the style of watch and its particular design, while inner layer 18 is made from a comfortable material. Either or both of the two layers may include an elastic material. In the watchband arrangement shown in FIG. 1, the open ends of watchband 12 preferably include a loop-type fastener 19 (e.g. a Velcro-type fastener) which is arranged to secure both open ends together to form a loop and thereby fasten the watchband around the wearer's wrist.

Figure 4:
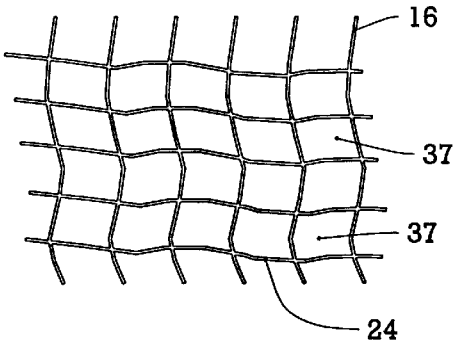
FIG. 4 is a top view of the net material used in the manufacture of the present watch, in accordance with the first embodiment of the invention.

In accordance with this preferred embodiment, referring to FIG. 4, covering 16 is generally rectangular and includes two opposing sides 24 and two opposing ends 26. Opposing sides 24 are secured between inner layer 18 and outer layer 20 using an appropriate adhesive 25 (hot-melt, or any other known bond), so that covering 16 forms a tubular shape around outer layer 20, as shown in FIG. 1. Opposing ends 26 define the length of the tubular structure. The tubular structure defines a central section 28 and a cavity 30 which holds watch case 14 (and other items, as desired) to the watchband 12.

Opposing ends 26 preferably have a smaller effective circumference than the effective circumference of a central section 28. The result is that watch case 14 of a predetermined size, once positioned within cavity 28 may freely slide within cavity 28 along the length of the tubular structure, as indicated by a arrow 32, but cannot escape the cavity through the openings defined by either end 26. Alternatively, opposing ends 26 of covering 16 may be secured directly to outer layer 20 of watchband 12 by stitching, an appropriate adhesive, or another means to ensure that cavity 30 is sealed at both ends. Whether opposing ends 26 of the tube are tightly secured to watchband 12, or are merely reduced in circumference, depends on the intended application of watchband 12 and the design of the watch. If only watch case 14 is intended to be held within cavity 30, it is preferred that opposing ends 26 of the tube are merely reduced in circumference to prevent watch case 14 from escaping cavity 30 through the openings defined by opposing ends 26. If other smaller items, such as keys, are intended to be held within cavity 30, opposing ends 26 must be more completely secured to prevent the smaller items from escaping cavity 30 through openings defined by opposing ends 26.

Figure 5:
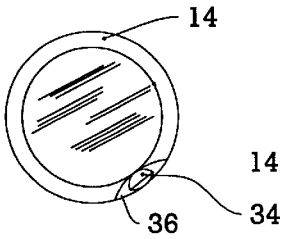
FIG. 5 is a rear view of the watch case, in accordance with the invention, showing details of a control stem located in a retracted position.
Figure 6:
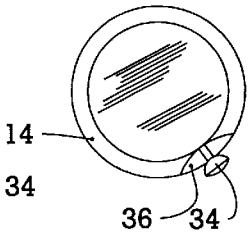
FIG. 6 is a rear view of the watch case of FIG. 5, showing the control stem in an extended and operative position.
Figure 7:
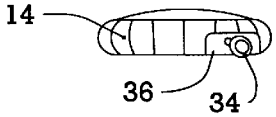
FIG. 7 is a side view of the watch case, showing the control stem located in its extended and operative position.

Watch case 14 is preferably ellipsoidal in shape (similar to the shape of an Advil-brand medicine tablet), and has a smooth exterior. Watch case 14 of the present invention preferably includes no pin support arms which are generally used to secure conventional watchbands to conventional watch cases. As shown in FIGS. 5, 6, and 7, a control knob 34, used to manually change the position of the hands located on the watch (analog or digital) is movable between a retracted position (see FIG. 5) and an extended position (see FIG. 6). In the retracted position, control knob 34 is positioned within a recess 36 formed in the watch case 14 and therefore will not become entangled in any openings of covering 16. Control knob 34 may simply be pulled from recess 36 and rotated, as necessary.

Covering 16 is preferably made from a material having a plurality of openings 37, such as a net material, as shown in FIGS. 1–4, but may be made from any material including leather, plastic film, any fabric including a cotton (e.g., denim) silk, wool, or any scrim, lace, or netting made from wire, string, cloth or plastic. Covering 16 preferably includes several openings 37, as in the case with the net-type covering 16 shown in FIGS. 1–4, so that watch case 14 (and other items) may be seen within cavity 30.

Watch case 14 may house only the appropriate timing movement to operate the watch or may be adapted to house an entire conventional watch, one which includes the pin support arms but does not include a conventional watchband. Watch case 14 in this instance would allow a conventional watch to be placed within cavity 30 while preventing any projections from reaching and entangling with any opening 37 located within covering 16 (this would be particularly useful when covering 16 is a net with many medium sized openings 37: between 1/16 to 1/4 inches). It is contemplated that a conventional watch case with its conventional watchband removed could slidably fit within cavity 30 without entangling openings 37 of covering 16 if openings 37 are sized appropriately (i.e., fairly small: less than 1/16 inches).

Figure 8:
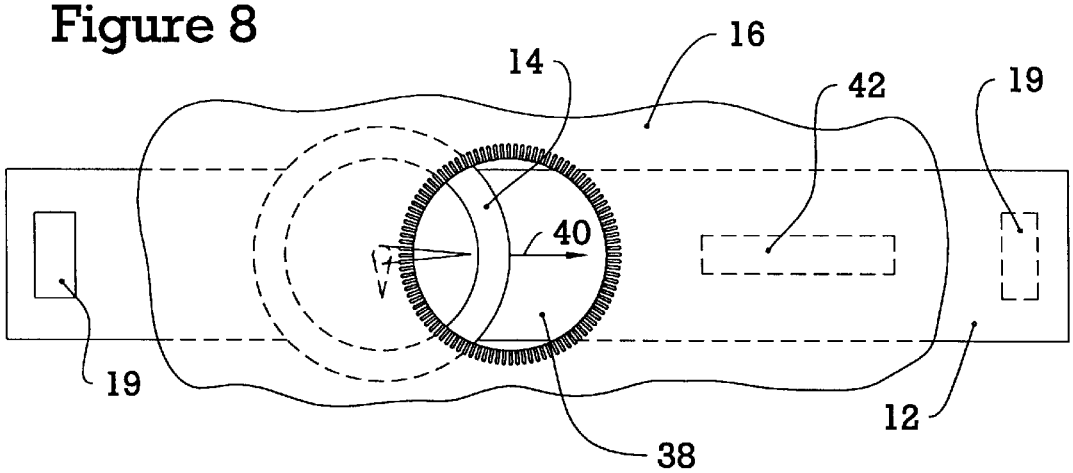
FIG. 8 is a top view of a wristwatch, in accordance with a second embodiment of the invention, showing a watchband, a covering and a watch case.

Covering 16 may also include only a single opening 38, as shown in FIG. 8, so that watch case 14 must be first moved within cavity 30 to a position wherein single opening 38 aligns with watch face. In FIG. 8, watch case 14 is shown being moved in the direction indicated by a arrow 40 within the cavity 30. Watch case 14 is shown still partially hidden and protected behind covering 16, only a portion of the watch face is in view through opening 38.

Covering 16 may be any length (as measured along the length of watchband 12) between a shortest length which is just slightly longer than the diameter of watch case 14 and a longest length which is equal to the length of watchband 12. The width of covering 16 may also vary depending on the size of watch case 14 and the number (or size) of the items intended to be stored within cavity 30 (e.g., keys, lip balm, etc.). It is preferred that covering 16 be sufficiently wide to easily accommodate watch case 14 so that watch case 14 may freely move within cavity 30 as watchband 12 is worn. The wearer may even have to search for watch case 14 within cavity 30, as viewed through any openings 37 (or single opening 38) before the time may be determined. This searching is intended to provide a playfulness in telling time. The covering material may also be made to restrict or limit the movement of the watch case as desired, depending on the particular market group (e.g., children or adults) the particular watch is intended.

Covering 16 may also be relatively close in length and width so that the resulting cavity 30 is only large enough to provide the watch case with limited movement with respect to watchband 12 (or no movement at all).

Covering 16 may also be pre-formed into a tube prior to being secured to watchband 12. In such instance, outer layer 20 may be inserted into tubular covering 16 and thereafter bonded to inner layer 18 located outside the tubular covering 16.

Covering 16 (when pre-formed into a tube) may also function as watchband 12 itself, including only fasteners 19 at each end to allow the covering/watchband to form a loop and be secured about a wearer's wrist.

Figure 3:
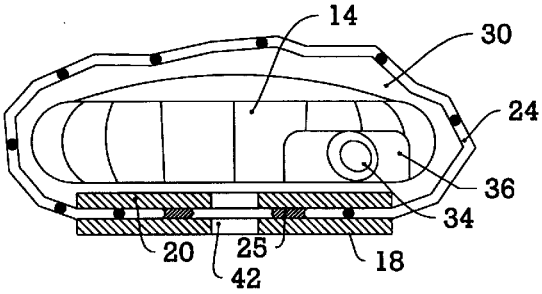
FIG. 3 is a sectional front view of the wristwatch, taken along the lines 3–3 of FIG. 2, showing details of the watch case positioned within a net, in accordance with the first embodiment of the invention.

In a related embodiment, covering 16 may be preformed to a tubular shape which is then rolled along its longitudinal axis to form a torroid (donut shape) of covering 16, thereby defining a torroidal cavity. The torroidal cavity may be used to house a watch case 14 which may be ellipsoid shaped, as shown in FIGS. 3, 5 and 6, or may be generally spherical in shape. In this case, the torroidal watchband is made from a flexible and/or elastic material, preferably a nylon lattice scrim so that it may be comfortably slipped over a wearer's hand and held in place about a wearer's wrist. The torroidal shape may be retained by securing the rolled covering material in the torroid shape using an appropriate adhesive, a heat weld, or stitching. Furthermore, the torroidal watchband may be supplied with an inner watchband (of any appropriate material including a sweatband material) to provide comfort to the wearer's skin. As described below, a slit may be provided to provide access to the torroidal cavity.

Watchband 12 includes a slit 42, preferably located in the center of watchband 12, and parallel to the length of watchband 12, as shown in FIGS. 1, 3, and 8. Slit 42 functions as an entry port to cavity 30. Slit 42 is long enough to pass watch case 14 so that watch case 14 may be removed, to be replaced, repaired, or otherwise adjusted, and re-inserted through slit 42 back into cavity 30. Other items may be similarly passed through slit 42 to and from cavity 30, as desired. The slit 42 will effectively close tight when the watch is being worn.

Figure 9:
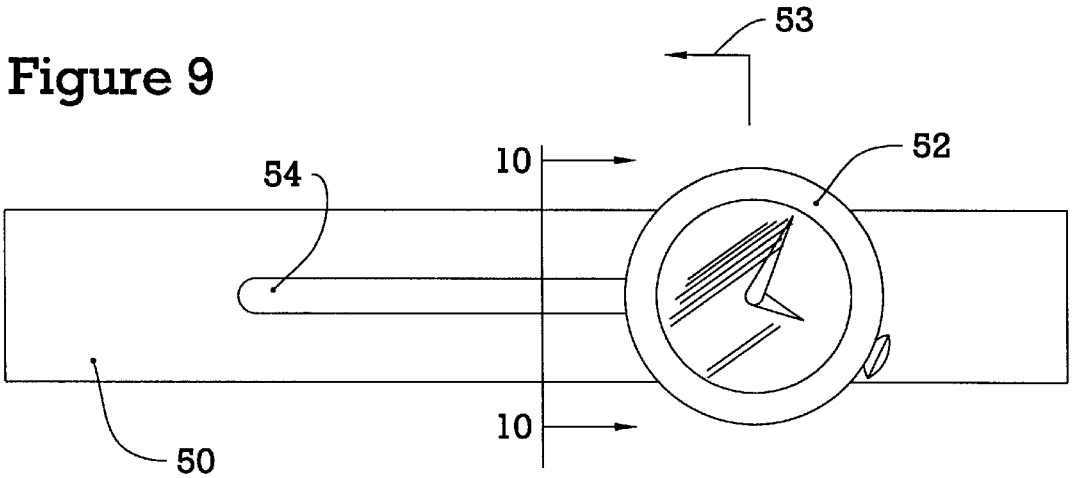
FIG. 9 is a top view of a wristwatch, in accordance with a third embodiment of the invention, showing a watchband and a watch case.
Figure 10:
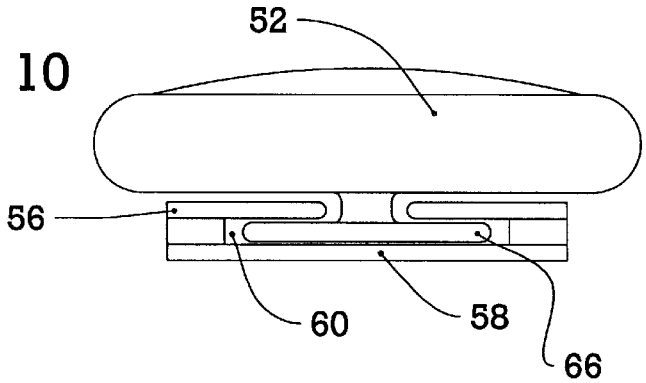
FIG. 10 is a sectional front view of the wristwatch, taken along the lines 10—10 of FIG. 9.
Figure 11:
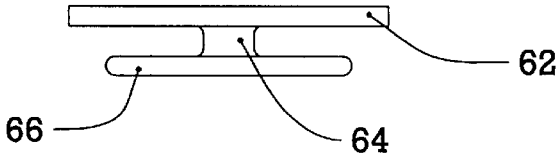
FIG. 11 is a side view of a backplate of the watch case, in accordance with the third embodiment.

Referring now to FIGS. 9, 10 and 11, a watch in accordance with another embodiment of the invention is shown including a watchband 50 and a watch case 52. Watchband 50 includes a centrally located reinforced slot 54 longitudinally disposed along a predetermined length of watchband 50, as shown in FIG. 9. Watchband 50 preferably includes an outer layer 56 and an inner layer 58. Slot 54 preferably extends only though outer layer 56. Inner layer 58 is secured to an underside of outer layer 56 along the longitudinal edges of the inner and outer layers so that a cavity 60 is defined which is disposed adjacent to slot 54.

Watch case 52 includes a back plate 62 which includes a projecting shaft 64 having a disc-like head 66. Shaft 64 is sized and shaped to slidably engage with slot 52 while head 66 is adapted to be received within and slide along the length of cavity 60. Head 66 is larger than slot 54 and therefore cannot be inadvertently removed therefrom.

Watch case 52 is slidably attached to watchband 50 and may freely rotate and slide along the length of slot 54 around a wearer's wrist. The sliding action offered to the watch case with respect to the watchband, in accordance with the present invention, provides the wearer with an aesthetically pleasing, interesting, and entertaining timepiece, unlike conventional wrist watches. Referring to FIG. 9, the watch case 52 may slide from the position shown in the direction indicated by arrow 53.

Applicant contemplates manufacturing the watch shown in FIGS. 1–7, in accordance with the first embodiment of the invention, so that the watch case, the covering material, and the band are colored and appropriately shaped and patterned to portray a particular sport or event. For example, if the sport of ice hockey were to be depicted by the present watch, the watch case would be shaped like a hockey puck and colored black, the covering material would be similar to the particular net material used in the hockey goal, and colored white, and the watchband would be colored white with one wide red and one wide blue stripe. The overall theme of this particular watch is unmistakably be the sport of ice hockey.

Another example is baseball wherein the watch case is shaped, colored and patterned as a baseball (it may be either spherical or ellipsoidal), the covering material is a netting material and may be white in color. The watchband is preferably light green (similar to the color of the turf or grass) and may include diamond shaped patterns (representing bases) or splotches of a tan color (representing the dirt between the bases).

Any sport can be likewise represented by designing, shaping, and coloring the watch case, the watchband and the covering material. These sports include, but are not limited to tennis, basketball, football, soccer, in-line skating, golf, lacrosse, and skiing.

The popular sport of snow-boarding could be represented by various desirable drab (grunge-like) or earth-tone colors and designs. Also, it is contemplated that the watchband be made extra-long with several adjustments so that the watchband may be fastened around the wearer's wrist, outside the wearer's ski jacket. This arrangement allows the wearer to easy see the watch without removing gloves or a jacket. The covering material may be a net-like material or, preferably, a solid insulative material (as is known in the art, such as Thinsulate (trademark), typically used in the manufacture of ski jackets) with a single opening so that the watch case may be selectively moved between a region wherein the timepiece is protected against direct cold (and snow) and a less protective region aligned with the opening so that the dial of the watch case may be seen and read.

Furthermore, popular team names and logos of sports teams may also be imprinted on the watchband, the covering material, and/or the watch case. Applicant contemplates that the present watch appropriately designed can be used a marketing give-away item at special events such as during a baseball game, providing a similar effect to that of "bat day" or "ball day", commonly used today at baseball stadiums as an added attraction.

The watch may portray themes enjoyed by children including popular cartoon characters, for example, a fish in a net, a spider in a web, etc. The present watch may also be used as an attractive means to advertise or to further popularize a growing trend, such as the use of the internet (wherein the watch having a net-like covering could be called "the inter-net" watch) or use of the world-wide-web (called the "web-watch").

Regardless of the particular design, the covering material of the present invention (as illustrated in FIGS. 1–8), may be removable from the watchband so that all three main items, the watchband, the covering, and the watch case may be purchased and replaced separately. This allows the wearer to quickly change the overall appearance of the watch without buying another watch, just by replacing the watchband, for example.

What is claimed is:

1. A wrist watch comprising:

a watch case containing a timing movement and having a display;

a watchband defining a longitudinal axis; and means for loosely securing said watch case to said watchband so that said watch case is freely slidable along said longitudinal axis under the influence of gravity.

2. A wrist watch comprising:

a watch case containing a timing movement and having a display;

a watchband;

a covering material attached to said watchband, said covering material defining a cavity, said watch case being positioned and freely movable within said cavity; and said covering material including at least one opening to which said watch case may be aligned so that said display is viewable through said opening and time may be read.

3. The wrist watch according to claim 1, wherein said securing means includes a tube attached to said watchband, said tube defining an elongated cavity which is sized and shaped to receive said watch case.

4. The wrist watch according to claim 3, wherein said tube is made from a flexible woven material.

5. The wrist watch according to claim 3, wherein said tube includes at least one opening that allows said display to be viewed from a point located outside said tube.

6. The wrist watch according to claim 4, wherein said woven material is a netting.

7. The wrist watch according to claim 3, wherein the ends of said tube are closed to prevent inadvertent removal of said watch case from said cavity.

8. The wrist watch according to claim 3, wherein said watchband includes an opening positioned adjacent to said cavity, said opening providing access to said cavity and being sized and shaped to receive said watch case so that said watch case may be selectively removed from and inserted into said cavity.

9. The wrist watch according to claim 1, wherein said securing means includes a slot located within said watchband and a projecting portion extending from said watch case, said slot being adapted to slidingly receive said projecting portion so that said watch case may move along said longitudinal axis.

10. A wrist watch, comprising:

a watch case containing a timing movement and having a display;

a watchband defining a longitudinal axis; and a covering material made from woven strands defining a plurality of openings located between the strands, said covering material covering said watch case and being attached to said watchband, said openings being of sufficient size to allow said display to be continuously viewed.

* * * * *